United States Patent [19]

Iizuka et al.

[11] 4,186,715

[45] Feb. 5, 1980

[54] SPLIT ENGINE OPERATION OF CLOSED LOOP CONTROLLED MULTI-CYLINDER INTERNAL COMBUSTION ENGINE

[75] Inventors: Haruhiko Iizuka, Yokosuka; Nagayuki Marumo, Yokohama, both of Japan

[73] Assignee: Nissan Motor Company Limited, Yokohama, Japan

[21] Appl. No.: 947,164

[22] Filed: Sep. 28, 1978

[30] Foreign Application Priority Data

Nov. 22, 1977 [JP] Japan ..... 52-157028[U]

[51] Int. Cl.[2] ..... F02D 17/00

[52] U.S. Cl. ..... 123/198 F; 123/32 EE; 123/119 EC; 60/276

[58] Field of Search ..... 123/198 F, 32 EE, 119 EC; 60/276, 285

[56] References Cited

U.S. PATENT DOCUMENTS

| | | | |
|---|---|---|---|
| 2,875,742 | 3/1939 | Dolza | 123/198 F |
| 3,756,205 | 9/1973 | Frost | 123/198 F |
| 3,765,394 | 10/1973 | Francis | 123/198 F |
| 3,916,622 | 11/1975 | Gospodar | 123/198 F |
| 4,015,428 | 4/1977 | Kawai | 123/198 F |
| 4,107,921 | 8/1978 | Lizuha | 123/198 F |
| 4,121,554 | 10/1978 | Sueishi et al. | 123/32 EE |
| 4,143,623 | 3/1979 | Norimatsu et al. | 123/32 EE |

*Primary Examiner*—Ira S. Lazarus

*Attorney, Agent, or Firm*—Schwartz, Jeffery, Schwaab, Mack, Blumenthal & Koch

[57] ABSTRACT

A split engine operation of a multi-cylinder internal combustion engine having a closed loop or feed back control system is disclosed. At split engine operation mode, the feed back control will be suspended, and at full cylinder engine operation mode, the feed back control will be resumed. A relay is provided to suspend the supply of output from a PI detector to a fuel injection control unit. The relay is circuited with a cylinder selector unit via a counter so that the resumption of the supply of the output from the PI detector to the fuel injection control unit will take place when a predetermined time duration has past after the engine operating condition switched into full cylinder engine operation mode from split engine operation mode.

2 Claims, 5 Drawing Figures

SPLIT ENGINE OPERATION OF CLOSED LOOP CONTROLLED MULTI-CYLINDER INTERNAL COMBUSTION ENGINE

BACKGROUND OF THE INVENTION

This invention relates to an internal combustion engine control system and, in particular, to a charge forming device to effect split engine operation of a multi-cylinder internal combustion engine having a closed loop or feed back control system including an exhaust sensor.

A multi-cylinder internal combustion engine is known which has a three-way catalytic converter in an exhaust system and a feed back control system in which the quantity of fuel fed to the engine is controlled in response to the output from an oxygen sensor, which detects the oxygen concentration of the exhaust gases, in order to maintain the air fuel ratio of the mixture at the stoichiometry whereupon the three-way catalytic converter can operate most efficiently.

It is also known to operate a multi-cylinder internal combustion engine by suspending the supply of fuel to selected cylinders, reduced in number, of all to deactive the same and by increasing the load on the remaining activating cylinders to operate the same under high load conditions in which fuel economy is good.

This is known as means for improving fuel economy of the engine. Applying this means to a multi-cylinder internal combustion engine provided with a three-way catalytic converter and a feed back control system will cause the air fuel ratio of the exhaust gases to deviate considerably from the stoichiometry toward the lean side when the engine operating condition shifts to split engine operation mode because at this engine operation mode the exhaust gases discharged from the activating cylinders will be diluted with air discharged from the deactivated cylinders. As a result, the quantity of fuel supplied to the activating cylinders will be increased excessively in accordance with the output from the oxygen sensor which represents the oxygen concentration of the exhaust gases containing oxygen of air discharged from the deactivated cylinders, thereby to deteriorate the driveability and thus worsening the fuel economy.

Under split engine operating condition, the engine operates efficiently because the activating cylinders operate under high engine load. Therefore, the feed back control may be suspended under split engine operating condition because under this condition the exhaust emissions discharged from the engine cylinders are not at high levels.

If, in such a control as above, the feed back control is resumed concurrently when the engine operating condition shifts back into full cylinder operating mode from split operation mode, the quantity of fuel injection will excessively increase upon this shifting because the oxygen sensor detects the oxygen concentration of the exhaust gases resulting from the split operating condition of the engine for a predetermined time duration after the engine operating condition has shift back into full cylinder operation mode from split operation mode (ref. FIG. 1).

SUMMARY OF THE INVENTION

It is therefore an object of the present invention to provide a split engine operating system in which resumption of feed back control system will be delayed for a predetermined time duration after the engine operating condition shifts back into full cylinder operation mode from split operation mode in order to prevent enrichment of air fuel mixture upon shifting back into full cylinder mode from split cylinder mode, which otherwise would occur.

DESCRIPTION OF THE PREFERRED EMBODIMENT

Figure 1:
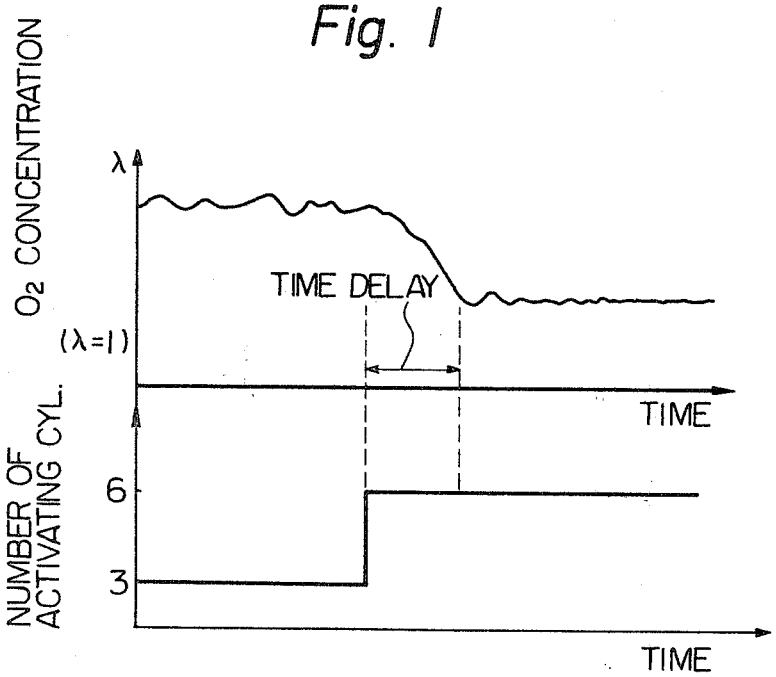
FIG. 1 is a graph showing a variation in the oxygen concentration of the exhaust gases discharged from a 6-cylinder internal combustion engine when the engine operating condition shifts into full-cylinder mode operation from split operation mode.
Figure 2:
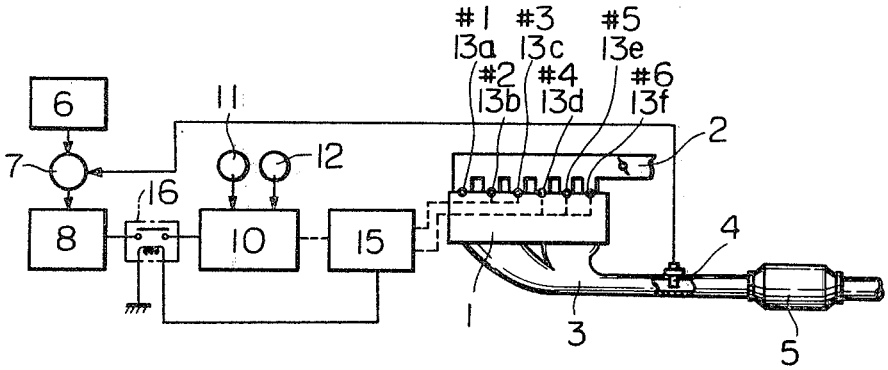
FIG. 2 is a schematic diagram of an engine control system embodying the invention.

In FIG. 2, the reference numeral denotes a 6-cylinder internal combustion engine; the reference numeral 2 an intake manifold; the reference numeral 3 an exhaust manifold; the reference numeral 4 an oxygen sensor; and the reference numeral 5 a three-way catalytic converter.

The oxygen sensor 4 detects the concentration of oxygen of the engine exhaust gases to provide an output representing the oxygen concentration, the output being in the form of a voltage signal. The output from the oxygen sensor 4 is fed to a deviation detector 7 where it will be compared with a predetermined signal provided by an air fuel ratio setting device 6. The predetermined signal is a voltage signal which represents the stoichiometry (excess oxygen ratio $\lambda=1$). The deviation detector 7 provides an output representing the deviation. This output is fed to a PI detector 8.

The PI detector 8 is employed to improve the response characteristics of the control. It will provide an output which is the sum of a voltage signal proportional to the deviation representing output and a voltage signal proportional to an integrated value of the deviation representing output. The output from the PI detector 8 is fed to a fuel injection control unit 10.

The fuel injection control unit 10 will determine the proper fuel injection timing and fuel injection duration in accordance with outputs from an intake air sensor 11 and an engine revolution speed sensor 12 to provide a fuel injection pulse signal to be supplied to electrically energizable fuel injectors 13*a*, 13*b*, 13*c*, 13*d*, 13*e* and 13*f*.

In the fuel injection control unit 10, the output from the PI detector 8 is used to adjust or compensate for the pulse width of the fuel injection signal so that the air fuel ratio of the air fuel mixture will approach the stoichiometry.

The reference numeral 15 denotes a cylinder selector unit which, when the engine runs under light load, will prevent the supply of the fuel injection signal to the fuel injectors 13*a*, 13*b* and 13*c* to prevent them from discharging fuel to the corresponding cylinders #1 to #3 so that the engine will run on the remaining activating cylinders #4 to #6. When the engine runs under light load, the cylinder selector unit 15 will isolate the fuel injection control unit 10 from the PI detector 8 so as to cause the fuel injection control unit 10 to determine the pulse width in accordance with the parameters except the output from the PI detector 8, such as the outputs from the intake air sensor 11 and the engine revolution speed sensor 12, so that under this load condition the pulse width of the fuel injection signal supplied to the cylinders #4 to #6 will not be affected by the output from the PI detector 8. After the engine operating condition has shifted from 3-cylinder mode in which the engine runs on the selected three cylinders of all into 6-cylinder mode in which the engine runs on all cylinders, the cylinder selector unit 15 will permit the resumption of the supply of output from the PI detector 8 to the fuel injection control unit 10. The resumption will take place when a predetermined time duration has past after this shifting of the engine operating condition from 3-cylinder mode into 6-cylinder mode. The suspension of the supply of the output from the PI detector 8 to the fuel injection control unit 10 is effected by a relay 16. Preferably, the predetermined time duration shall not be shorter than one cycle of the engine.

The cylinder selector unit 15 will now be described more in detail with reference to FIGS. 3 through 5.

Figure 5:
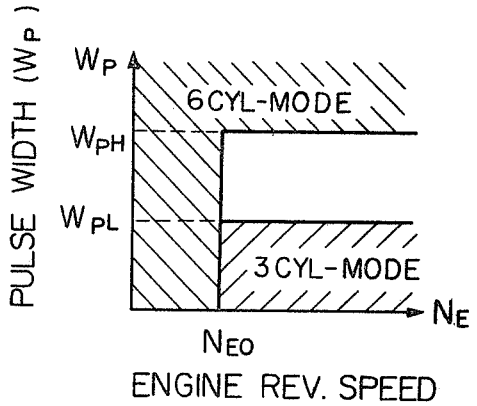
FIG. 5 is operation mode diagram provided by the cylinder selector unit.

Referring to the operation mode diagram shown in FIG. 5 provided by the cylinder selector unit 15, the engine revolution speed and the fuel injection pulse width (representing the engine load) are represented by $N_E$ and $W_P$ respectively. When the revolution speed $N_E$ is lower than a predetermined level $N_{EO}$ the cylinder selector unit 15 will permit the engine to run on six cylinders regardless of the variation in the engine load in order to prevent engine vibration. When the revolution speed $N_E$ is higher than the predetermined level $N_{EO}$ and also when the pulse width $W_P$ is lower than a lower predetermined pulse width level $W_{PL}$ the cylinder selector unit 15 will permit the engine to run on selected three cylinders of all (3-cylinder mode). When the revolution speed $N_E$ is higher than the predetermined level $N_{EO}$ and the pulse width $W_P$ is higher than a higher predetermined pulse width level $W_{PH}$ the cylinder selector unit 15 will permit the engine to run on all of the six cylinders (6-cylinder mode). When the pulse width $W_P$ is within the range between the lower and higher predetermined levels $W_{PL}$ and $W_{PH}$ under the condition where the revolution speed $N_E$ is higher than the predetermined level $N_{EO}$ the same engine operating condition as that before the pulse width plunges into this region will be maintained.

Figure 3:
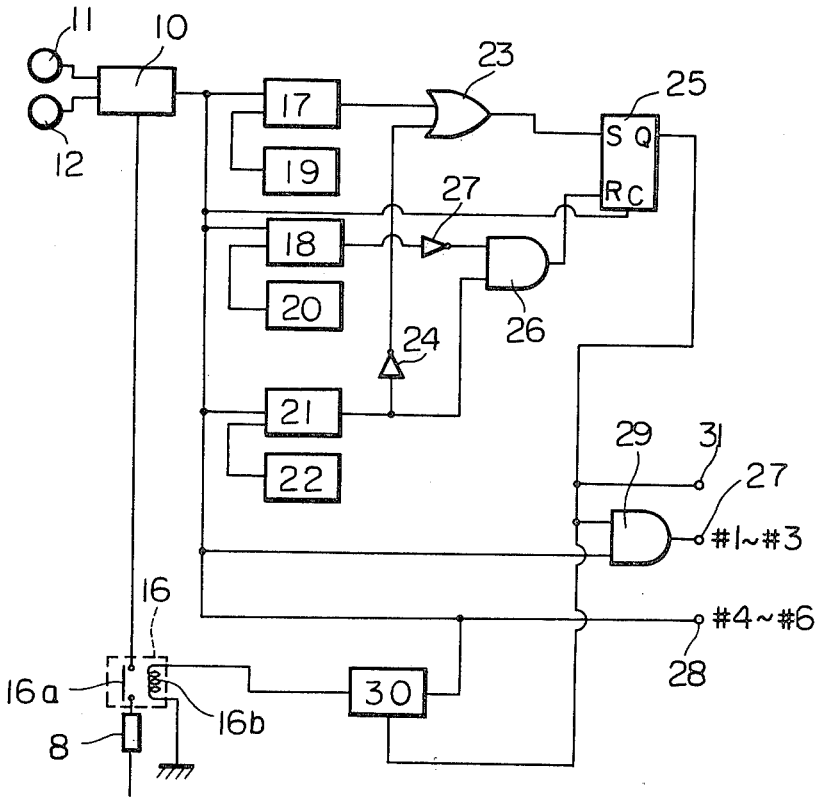
FIG. 3 is a circuit diagram a cylinder selector unit.

Referring to FIG. 3, the reference numerals 17 and 18 denote pulse width comparators, respectively, and the reference numerals 19 and 20 reference pulse width setting devices, respectively, for $W_{PH}$ and $W_{PL}$. The comparator 17 will provide a high level signal "1" when the pulse width $W_P$ is higher than the predetermined higher level $W_{PH}$ provided by the setting device 19. The comparator 18 will provide a high level signal "1" when the pulse width $W_P$ is higher than the predetermined low level $W_{PL}$.

The reference numeral 21 denotes an engine revolution speed comparator and the reference numeral 22 a setting device for the predetermined signal $N_{EO}$. The comparator 21 determines the engine revolution speed from the frequency of the fuel injection pulse signal (twice injections per one cycle) and produces a high level signal "1" when the engine revolution speed signal $N_E$ is higher than the predetermined signal $N_{EO}$.

The output from the pulse width comparator 17 is fed to one of two input terminals of an OR gate 23 and the output from the engine revolution speed comparator 21 is fed through an inverter 24 to the other input terminal of the OR gate 23. The OR gate 23 will provide a high level signal "1" at least one of the input is at a high level signal "1." The output from the OR gate 23 is fed to a set input terminal S of a flip-flop circuit 25.

The output from the pulse width comparator 18 is fed through an inverter 27 to one of two input terminals of an AND gate 26 and the output from the engine revolution speed comparator 21 is fed to the other input terminal of the AND gate 26. The AND gate 26 will provide a high level signal "1" only when the both inputs on its input terminals are at high level signals "1." The output from the AND gate 26 is fed to a reset input terminal R of the flip-flop circuit 25.

Therefore, the Q output of the flip-flop circuit 25 is a high level signal "1" when the pulse width $W_P$ is higher than the higher predetermined level $W_{PH}$ or when the engine revolution speed $N_O$ is lower than the predetermined level $N_{EO}$. It is a low level signal "0" when the pulse width $W_P$ is lower than the lower predetermined level $W_{PL}$ and when the engine revolution speed $N_E$ is higher than the predetermined level $N_{EO}$. When the pulse width $W_P$ is within the range between the higher and lower predetermined levels $W_{PH}$ and $W_{PL}$ under the condition in which the engine speed $N_E$ is higher than $N_{EO}$ the Q output will not change its state until a new input is applied to the set input terminal S or the reset input terminal R.

The reference numeral 27 denotes a terminal electrically connected to three fuel injectors **13*a* to 13*c* for cylinders #1 to #3, and the reference numeral 28 denotes another terminal which are electrically connected to the other three fuel injectors 13*d* to 13*f* for cylinders #4 to #6. The terminal 27 is connected to an output of an AND gate 29 which will permit the fuel injection pulse to pass therethrough to the terminal 27 when the Q output is a high level signal "1." The another terminal 28 is connected to the fuel injection control unit 10** so that the fuel injection pulse signal will appear thereon.

The flip flop circuit 25 uses a fuel injection pulse signal as a clock input to make the Q output synchronized with the fuel injection pulse.

Figure 4:
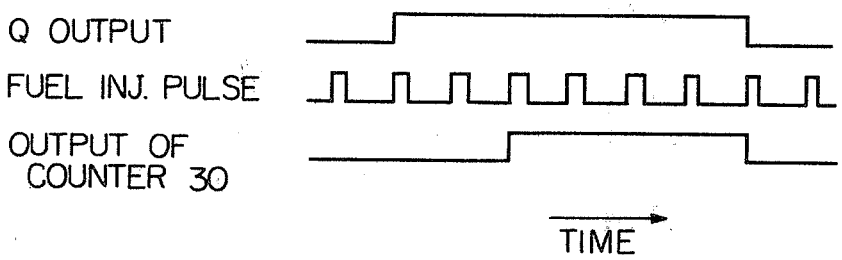
FIG. 4 is a timing diagram of the Q output from a flip flop circuit, the fuel injection pulse signal and the output from a clock counter.

In order to control the operation of a relay 16 which has a normally open switch **16*a* disposed between the PI detector 8 and the fuel injection control unit 10 and a relay coil 16*b*, a counter 30 is provided, as shown in FIG. 3, which, upon detecting a rising of the Q output, will commence to count the number of fuel injection pulses and will provide at its output a high level signal "1" when it has counted three pulses and which will produce a low level signal "0" upon detecting a dropping of the Q output (see FIG. 4). The output from the counter 30 is fed to the relay coil 16*b*. The relay coil 16*b* will be energized to close the switch 16*a*** only when the counter provides a high level signal "1."

Therefore, closure of the relay switch **16*a* will take place when the predetermined time duration, i.e., one cycle in this embodiment, has past after the Q output from the flip flop circuit 25 switched from a low level signal "0" to a high level signal "1." The closure of the relay switch 16*a* will resume the supply of the feed back control. Upon switching from the engine operation at 6-cylinder mode to that at 3-cylinder mode, the relay switch 16*a*** will be opened immediately or at the same time, thereby to suspend the feed back control.

The operation of the system is as follows: When the engine operates at 6-cylinder mode in which the flip flop circuit 25 provides a high level signal "1" at its Q output, the relay coil 16*b* will be energized to close the relay switch 16*a* so that the output from the PI detector 8 will be fed to the fuel injection control unit 10. Thus, under this condition, the fuel injection pulse which is basically determined based on the outputs from the air intake sensor 11 and the engine revolution sensor 12 will be compensated for in response to the oxygen concentration of the exhaust gases so that the air fuel ratio of the air fuel mixture to be fed to each of the six cylinders #1 to #6 will be at the stoichiometry. Since, under this condition, the AND gate 29 is opened, the fuel injection pulse is supplied to the fuel injectors 13*a* to 13*c* for cylinders #1 to #3 through the terminal 27, too.

When the engine operating condition shifts into a light load engine operating mode to cause the Q output from the flip flop circuit 25 to change from a high level signal "1" to a low level signal "0," the AND gate 29 will be closed. Closing of the AND gate 29 will prevent the fuel injection pulse from being supplied to the fuel injectors 13*d* to 13*f* for cylinders #1 to #3 and will cause the counter 30 to change its output to a low level signal "0." When a low level signal "0" appears as the output from the counter 30, the relay coil 16*b* will be deenergized, thereby to permit the relay switch 16*a* to return to its open state. Thus, under this condition, the feed back control will be suspended and the engine will be allowed to run on three cylinders #4 to #6.

Since, under this condition, the fuel injection pulse is not affected by the output from the oxygen sensor 4, the air fuel ratio of air fuel mixture to be fed to the cylinders #4 to #6 is determined by the fuel injection control unit 10 isolated from the PI detector 8, so that diluting the exhaust gases discharged from the cylinders #4 to #6 with air discharged from the deactivated cylinders #1 to #3, which pump air only, will not result in excessive enrichment of air fuel mixture to be fed to the activating cylinders #4 to #6. Referring to the pulse width of the fuel injection pulse supplied to the fuel injectors 13*d* to 13*f* for the activating cylinders #4 to #6, it is desired to increase the quantity of fuel upon each injection approximately double as much as that when the engine operates at 6-cylinder mode so as to prevent a drop in power from the engine upon shifting from 6-cylinder mode to 3-cylinder mode. This increase in the quantity of fuel can be performed by a compensating circuit, which is known, as soon as the Q output has switched to a low level signal "0." To this compensating circuit, not shown, the Q output from the flip flop circuit 25 is fed via a terminal 31.

Upon the engine operating condition switching from 3-cylinder mode to 6-cylinder mode whereupon the Q output will change from a low level signal "0" to a high level signal "1," the output from the counter 30 will not change concurrently to a high level signal "1" for the predetermined time duration to maintain the relay coil 16*b* energized. The predetermined time duration is set around the corresponding time duration to one cycle of the engine.

During this time duration, the feed back control is still suspended to keep the fuel injection pulse unaffected by the output from the PI detector 8 and, since the AND gate 29 is opened, the fuel injection pulse which is not affected by the PI detector 8 nor the compensating circuit is supplied to the fuel injectors 13*a* to 13*c* for cylinders #1 to #3, too, so as to cause the engine to operate on all of the six cylinders #1 to #6. Since, during this time duration, there still exists a considerable amount of oxygen having discharged from the cylinders #1 to #3, the total air fuel ratio of the exhaust gases from the engine exhaust pipe will be kept around the stoichiometry.

When the predetermined time duration has terminated after the switching from 3-cylinder mode to 6-cylinder mode, the relay coil 16*b* will be energized to resume the feed back control. At this stage, the oxygen concentration of the exhaust gases within an area in the proximity of the oxygen sensor 4 will not contain the excessive oxygen discharged from the once disabled cylinders #1 to #3 and will reflect the charge condition of each of the six cylinders #1 to #6.

It will therefore be understood that the problem that, upon switching from 3-cylinder mode to 6-cylinder mode, the air fuel ratio would become excessively rich if the feed back control is resumed concurrently upon the switching has been eliminated. It will also be understood that the feed back control will be resumed smoothly without considerable deviation from the target level of stoichiometry because the feed back control will not take place for the predetermined time duration after this switching.

As described above, since the resumption of the feed back control is delayed for a time duration corresponding to one cycle of the engine operation, an undesirable variation, in air fuel ratio, upon switching from 3-cylinder mode to 6-cylinder mode has been eliminated, thus avoiding degradation of the exhaust emissions and fuel economy inherent to such undesirable variation of the air fuel ratio.

The time duration for which the resumption of the feed back control will be delayed is not limited to one cycle but may be increased or decreased as the case may be. The mode of operation determined by the cylinder selector unit described above is presented as one of examples only so that the present invention can be equally applied to another cylinder selector unit providing different engine operating pattern including a split engine operation.

What is claimed is:

1. An engine control system for a multi-cylinder internal combustion engine having a plurality of cylinders consisting of a first group of cylinders and a second group of cylinders, said system comprising:

an oxygen sensor provided in an exhaust system of the engine;

means for supplying fuel to the engine;

means responsive to load on the engine for preventing fuel to be supplied to the first group of cylinders to effect split operation of the engine;

means responsive to an output from said oxygen sensor for controlling said fuel supplying means to effect feed back control; and means whereby the feed back control is suspended during the split operation of the engine and for a predetermined time duration after the termination of the split operation of the engine.

2. An engine control system as claimed in claim 1, in which said fuel supplying means includes a fuel injection control unit to provide a fuel injection pulse signal; and in which said last mentioned means includes a counter means for counting a predetermined number of pulses of the fuel injection pulse signal appearing after the termination of the split operation of the engine; and a relay means for establishing operative connection between said controlling means and said fuel supplying means when said counter has counted said predetermined number of pulses.

* * * * *